United States Patent [19]

Harris et al.

[11] Patent Number: 5,069,713

[45] Date of Patent: Dec. 3, 1991

[54] PERMANENT MAGNETS AND METHOD OF MAKING

[75] Inventors: Ivor R. Harris; Syed H. Safi, both of Birmingham, Great Britain

[73] Assignee: The University of Birmingham, Edgbaston, England

[21] Appl. No.: 177,388

[22] Filed: Apr. 4, 1988

[30] Foreign Application Priority Data

Apr. 2, 1987 [GB] United Kingdom ..... 8707905

[51] Int. Cl.[5] ..... C22C 29/12

[52] U.S. Cl. ..... 75/232; 75/228; 75/244; 419/19; 428/570; 428/469

[58] Field of Search ..... 75/244, 254, 232, 228; 252/62.51; 148/101, 105, 303, 311, 302; 419/19; 428/570, 469

[56] References Cited

U.S. PATENT DOCUMENTS

| | | | |
|---|---|---|---|
| 4,200,547 | 4/1980 | Beck | 148/101 |
| 4,431,604 | 2/1984 | Sata et al. | 419/23 |
| 4,543,208 | 9/1985 | Horie et al. | 252/62.54 |
| 4,837,114 | 6/1989 | Hamada et al. | 148/101 |
| 4,854,979 | 8/1989 | Wecker | 148/103 |
| 4,865,915 | 9/1989 | Okonogi et al. | 148/101 |

FOREIGN PATENT DOCUMENTS

| | | |
|---|---|---|
| 0284033 | 3/1987 | Japan . |
| 0169403 | 7/1987 | Japan . |

OTHER PUBLICATIONS

A. L. Robinson, "Powerful New Magnet Material Found", Science, vol. 223, Mar. 84, pp. 920-922.

*Primary Examiner*—Brooks H. Hunt
*Assistant Examiner*—Ngoclan T. Mai
*Attorney, Agent, or Firm*—Fleit, Jacobson, Cohn, Price, Holman & Stern

[57] ABSTRACT

A non-sintered permanent magnet is formed by a cold compacting technique or by resin bonding using particles of a stoichiometric alloy (e.g. $R_2Fe_{14}B$ where R is at least one rare earth and/or yttrium, particularly La, Ce, Pr, ND or Y or a mixture thereof) which have been coated with a reaction product of the alloy or a non-magnetic metal such as Sn, Ga, Zn, Al, or Cu. The use of a stoichiometric alloy avoids the presence of a reactive grain boundary phase normally present in non-stoichiometric alloys.

11 Claims, No Drawings

PERMANENT MAGNETS AND METHOD OF MAKING

BACKGROUND OF THE INVENTION

This invention relates to magnets and, more particularly, but not exclusively, to iron-rare earth-boron or iron-cobalt-rare earth-boron type magnets, and a method of production thereof. Iron-rare earth-boron and iron-cobalt-rare earth-boron type magnets are disclosed in U.S. Pat. No. 4,601,875, and European Patents EP-A-0101552 and EP-A-0106948. In particular, U.S. Pat. No. 4,601,875 and EP-A-0101552 disclose the production of permanent magnets based on the Fe.B.R system wherein R is at least one element selected from light-and heavy-rare earth elements inclusive of yttrium (Nd, Pr, La, Ce, Tb, Dy, Ho, Er, Eu, Sm, Gd, Tm, Yb, Lu and Y) and wherein the B content is 2 to 28 atomic percent, the R content is 8 to 30 atomic percent and the balance is iron. Such a permanent magnet is produced by providing a sintered body of the alloy. U.S. Pat. No. 4,601,875 requires the sintered body to be heat treated (or aged) at 350° C. to the sintering temperature for 5 minutes to 40 hours in a non-oxidizing atmosphere. The aging process is believed to promote growth of a grain boundary phase which imparts coercivity. U.S. Pat. No. 4,601,875 also discloses alloys in which cobalt can be substituted for iron in an amount not exceeding 45 atomic percent of the sintered body. Additionally, U.S. Pat. No. 4,601,875, EP-A-0101552 and EP-A-0106948 disclose the possibility of including at least one of additional elements M in certain specified maximum amounts, M being selected from Ti, Ni, Bi, V, Nb, Ta, Cr, Mo, W, Mn, Al, Sb, Ge, Sn, Zr and Hf.

However, the above processes are relatively expensive in that they involve having to sinter at an elevated temperature and then age the sintered body.

Additionally, sintering has an affect on the particle size in the sintered body and so it is not always possible to optimize the particle size, with the result that the magnetic properties can suffer. Also, sintered magnets are difficult to machine.

With alloys based on the Fe.B.R system, the grain boundary phase, which is always present in the non-stoichiometric alloys, is very susceptible to oxidation, with the result that such alloys are very difficult to use in the manufacture of polymer bonded magnets and also have to be protected to prevent corrosion in service.

BRIEF SUMMARY OF THE INVENTION

We have found that useful permanent magnets of the above system (which will be referred to hereinafter as "the Fe.B.R system") can be produced without the need to sinter and age certain alloys of such a system.

DETAILED DESCRIPTION

According to one aspect of the present invention, there is provided a permanent magnet comprising a coherent, non-sintered body which contains or is composed of a particulate, substantially stoichiometric alloy having uniaxial magnetocrystalline anisotropy, wherein the surfaces of the particles have a continuous coating thereon which is formed of a reaction product of the alloy or which is formed of a non-magnetic metal (e.g. Sn, Ga, Zn, Al or Cu).

Permanent magnets of the present invention do not use non-stoichiometric alloys, which alloys have previously been used so as to produce a non-magnetic grain boundary phase which imparts coercivity. For example, the fall in permanent magnetic properties as the neodymium content approaches that in stoichiometric $Nd_2Fe_{14}B$ is apparent from "New material for permanent magnets on a base of Nd and Fe", M. Sagawa et al, J. Appl. Phys. 55(6), 15 Mar. 1984 in respect of sintered and post-sintering heat treated specimens. Such specimens are shown as possessing decreasing permanent magnetic properties as the neodymium content approaches that of the stoichiometric alloy.

In the present invention, there can be employed stoichiometric, $R_2Fe_{14}B$ where R is at least one rare earth metal and/or yttrium, particularly La, Ce, Pr, Nd, Dy or Y or a mixture of any one or more of these e.g. mischmetal. The use of a stoichiometric alloy potentially enables the remanence of the magnet to be optimized. Other stoichiometric alloys which may be suitable are $SmCo_5$; $SmFe_{11}Ti$; $Sm_2(Co,Fe,Cu,Zr)_{17}$; $R_2Fe_{14-x}Co_xB$ where R is as defined above and x is less than 14; and stoichiometric alloys of the types disclosed in British Patent No. 1554384, namely $A_xB_y$ type alloys where x:y approximates to the following pairs of integers 5:1, 7:2 and 17:2, and where A is at least one transition metal, preferably cobalt and/or iron and B is at least one of rare earth elements, cerium and yttrium, preferably Sm or Pr or Ce-enriched mischmetal.

Additionally, the invention is applicable to stoichiometric alloys of the Fe.B.R- or Fe.Co.B.R.-type which additionally includes at least one of additional elements selected from Ti, Ni, Bi, V, Nb, Cu, Ta, Cr, Mo, W, Mn, Al, Sb, Ge, Sn, Zr, Ga, Si and Hf. These additional elements substitute for a minor proportion of the iron and may assist in providing a stable reaction product coating. In this latter respect, Cr and/or Al are considered to be particularly suitable in view of their stable oxides. The alloy may contain minor amounts (e.g. about 1.5 wt. %) of heavy rare earths, e.g. dysprosium, to increase coercivity.

The advantageous effects of the present invention reduce as the composition of the alloy employed to form the particles departs from the stoichiometric, accordingly the alloys used in the present invention are stoichiometric or substantially stoichiometric.

According to another aspect of the present invention, there is provided a method of producing a permanent magnet comprising the steps of forming particles from a substantially stoichiometric alloy having uniaxial magnetocrystalline anisotropy; providing a continuous coating thereon which is formed of a reaction product of the alloy or which is formed of a non-magnetic metal (e.g. Sn, Ga, Zn, Al or Cu); and forming a coherent non-sintered body which consists of or contains the coated alloy particles.

The stoichiometric alloy may be produced by melting the alloy ingredients in the required proportions to produce an ingot which is subsequently homogenized to produce a single phase material before comminution to form the particles. Particularly in the case of alloys of the $R_2Fe_{14}B$ type, the alloy is usually homogenized in order to eliminate or at least reduce the amount of free iron. Depending upon the production history of the alloy, the homogenization time may be from 4 hours upwards. We have found however that with the as-cast alloy samples which are currently under investigation ($Nd_2Fe_{14}B$), a sudden drop in the free iron content occurs after about 50 hours treatment at 1100° C.

Accordingly, it is preferred to effect homogenization for at least about 50 hours, and more preferably for about 50 to 350 hours. However, after about 110 hours, we have observed that rate of reduction of the free iron content is very much less than that which occurs between 50 and 60 hours. The homogenization temperature is preferably 1100° C., although temperatures as low as 900° C. or as high as 1200° C. may be utilized, if necessary. The amount of free iron in the as-cast alloy can vary quite considerably depending upon the cooling conditions prevailing at the time when the molten alloy is cast into ingots. Slow cooling rates favor the production of free iron. The present invention also contemplates the use of alloys whose production process is controlled so as to minimize the formation of free iron. The present invention also contemplates the use of melt spun alloys or even the use of as-cast alloys which have been re-melted and cooled under suitably fast conditions to minimize free iron production.

Homogenization also serves to increase the crystal grain size which may enable the production of single crystal particles. The length of homogenization time has a marked effect on the BH max of the magnets produced from the $Nd_2Fe_{14}B$ alloys currently under investigation.

After homogenization of the alloy as required, the alloy material is roughly size reduced, e.g. using a power press and screening, to approximately 1 mm particles which are then further reduced in size e.g. by ball milling in an inert liquid e.g. cyclohexane. We have found it preferably to ball mill using a low energy mill, e.g. a slow roller mill, in order to limit uncontrolled oxidation of the powder being milled. Milling may be effected for up to 48 hours or more depending upon the size of the particles before milling, to produce a powder wherein the majority of the particles have a particle size not greater than 2 μm and substantially all the particles have a size less than 10 μm. Such milling is particularly applicable to alloy particles which are being co-milled with coating material as will be described hereinafter.

The particle size of the alloy is preferably as small as possible consistent with ease of handling. Typically, for stoichiometric Fe.B.R. alloys, the particle size is 1–3 μm or less and may even be of sub-micron size since this is possible without undue risk of uncontrolled oxidation because of the stability of the stoichiometric alloy compared with a rare earth-rich non-stoichiometric alloy.

The amount of binder may be 20% by weight or less, preferably 10% by weight or less and, for optimum magnetic properties, is kept to a minimum consistent with obtaining a body having an adequate mechanical strength for the intended use. The binder is preferably a polymer, most preferably a cold set polymer.

The reaction product of the stoichiometric alloy may be, for example an oxide, chloride, nitride, carbide, boride, silicide, fluoride, phosphide or sulphide. Conveniently, the compound coating is an oxide formed by oxidation of the stoichiometric alloy. Finely divided particles formed from a stoichiometric alloy of the Fe.B.R. or Fe.Co.B.R. system are less susceptible to spontaneous oxidation than particles of a non-stoichiometric alloy because of the absence of an easily oxidized R-rich phase thereon. Thus, the stoichiometric alloy particles are easier to oxidize in a controlled manner to produce a continuous oxide coating thereon. Controlled oxidation of the alloy particles can be effected by, for example, heating at a temperature of up to 80° C. in a dry air atmosphere for up to about 80 mins. However, it has been observed that, for alloys of the $R_2Fe_{14}B$ type, temperatures and times towards the lower ends of these ranges tend to give better results as well as being more economical to conduct. Thus, it is preferred to employ temperatures in the range of about 20° C. to 60° C., more preferably about 30° to 50° C., and times in the range of 5 to 40 minutes, more preferably 5 to 30 minutes, for dry air oxidation. These can be reduced for oxidation in pure oxygen. The oxide coating in the case of a stoichiometric $Nd_2Fe_{14}B$ system has not yet been fully investigated but it is believed that it may be $Nd_2O_3$ or $NdFeO_3$.

The use of an oxide layer to impart coercivity is particularly surprising because it is usual to take special precautions to avoid spontaneous combustion or undesirable oxidation of the non-stoichiometric alloys during pulverization and sintering.

Coating of the alloy particles with non-magnetic metal can be effected by electroless plating, volatilization of the coating metal, chemical vapor deposition, sputtering or ion plating. Alternatively, coating can be effected by co-milling a ductile non-magnetic metal with the magnet alloy material (e.g. in a single phase condition) under inert conditions, e.g. by ball milling or attritor milling under a protective, inert liquid such as cyclohexane, as mentioned previously. Alternatively, the magnetic alloy material can be milled under inert conditions to produce a fine powder (approximately 1 micron size), or a fine powder of such alloy can be produced by hydrogen decrepitation (as disclosed in GB 1554384 and also in Journal of Material Science, 21 (1986) 4107–4110) and removing hydrogen by vacuum degassing, e.g. at around 200° C., and then milling. Following this, the fine alloy powder can then be immersed in aqueous or organic solution containing the non-magnetic metal which is displaced from solution onto the alloy particle surface. Alternatively, the fine alloy powder can be electroless plated with the non-magnetic metal.

The amount of coating material provided in the alloy particles is kept to a minimum consistent with producing an effective coating thereover. Typically, the coating material accounts for about 10–15 or 10–20 wt % of the coated powder. The amount of coating material may be as low as about 5 wt %. In the case of co-milling, the amount of coating material included in the powder mixture being co-milled is found to have unexpected effects on the magnetic properties. For example, it has been observed that, in the case where $Nd_2Fe_{14}B$ powder is co-milled with copper as the coating material, there is a steady rise in the remanence up to at least 20 wt % copper, whereas the coercivity rises steeply to a maximum at about 5 wt % copper and then remains relatively constant for copper contents up to at least 20 wt %. These results were observed for coated powders which were magnetized and then isostatically pressed to a green compact which was then set in polymer and its magnetic properties measured. The reason why the coercivity does not exhibit a steady rise is not fully understood at present. It is possible that the particles, in the absence of any grain boundary phase, are dynamically unstable to an extent that, as the alignment field is removed, they start to misorientate and cancel each other out, but that addition of the soft coating metal not only creates some sort of coating but also provides a physical binder which prevents the particles from rotating. This naturally would depend upon the concentration of the soft metal. The relative uniformity in the values of coercivity throughout the 5 -20wt % range might be due to the presence of only a small amount of the copper coated on the particles with the remainder either present as a fine mixture or mechanically alloyed with the bulk material.

Increases in magnetic properties up to a maximum at about 10 hours milling time can be observed. Milling times of over about 2–3 hours are preferred depending upon the nature of the starting materials and the type of mill.

The permanent magnet body can be formed by cold compacting (e.g. rotary forging preferably under non-oxidizing conditions e.g. in an argon atmosphere) or can be formed, e.g. by compression molding or injection molding or by extrusion, to the required shape. The body may include a binder of a thermoplastic or thermosetting synthetic resin or a low melting point non-magnetic metal e.g. tin, in an amount such as to hold the coated alloy particles together. The choice of the binder is dictated by the intended use of the magnet.

During or just before formation of the coated particles into a body, the particles will be magnetically aligned using an externally applied magnetic force. As the applied alignment field is increased, better remanence and enhanced BH max are obtained. Typically, the alignment field is up to 1.5 tesla.

The invention will now be described in further detail in the following Examples.

COMPARATIVE EXAMPLE

As cast, 214B ingot ($Nd_2Fe_{14}B$,95% pure Nd) was homogenized at 1000° C. for 4 hours to reduce free iron and then wet milled for 2 hours in a planetary mill using 15 mm diam. balls and a small amount of cyclohexane as a wetting agent. The resultant particles, having an average particle size of 1–3 μm, were then dried and mixed with 10 wt. % polymer (in this example, METSET cold set polymer) and then pressed to form bodies which showed no coercivity (see the Table 1 below).

EXAMPLE 1

As cast, 214B ingot ($Nd_2Fe_{14}B$,95% pure Nd) was homogenized at 1000° C. for 4 hours to reduce free iron, hydrogen decrepitated under pressure at 150° C. and then, after removal of hydrogen by heating in vacuo at 200° C. wet milled for 2 hours in a planetary mill using 15 mm diam. balls and a small amount of cyclohexane as a wetting agent. The resultant particles were then dried and subjected to a controlled oxidation to provide a continuous oxide coating thereon by heating for two hours at 100° C. in air.

The resultant oxidized particles were mixed with 10 wt. % polymer (in this example, METSET cold set polymer) and then pressed to form permanent magnet bodies having the properties shown in the Table 1 below.

EXAMPLE 2

As cast, 214B ingot ($Nd_2Fe_{14}B$,95% pure Nd) was homogenized at 1000° C. for 4 hours to reduce free iron and then milled for 2 hours in a planetary mill using 15 mm diam. balls and a small amount of cyclohexane as a wetting agent. The resultant particles, having an average particle size of 1–3 μm, were then dried and subjected to a controlled oxidation to provide a continuous oxide coating thereon by heating for one hour at 100° C. in air.

The resultant oxidized particles were mixed with 10 wt. % polymer (in this example METSET cold set polymer) and then pressed to form permanent magnet bodies having the properties shown in the Table 1 below.

EXAMPLES 3 to 14

As cast, 214B ingot ($Nd_2Fe_{14}B$, 95% pure Nd) was homogenised at 1000° C. for 4 hours and then some samples were hydrogen decrepitated under pressure at 150° C. and vacuum degassed and other samples were crushed. The material thus produced was mixed with 10% of coating metal as specified in Table 1 below and co-milled in a planetary mill, using 6 mm diameter balls. The resulting powder showed a definite permanent magnetism thus indicating that the coating has produced the desired effect. However, the polymer bonded sample was very weak magnetically, and it was attributed to the poor coating. An X-ray scan of the powder also supported the above view.

In order to improve the coating, it was decided to abandon hydrogen decrepitated powder, and use the original material (small lumps) to co-mill variously with Zn and Sn powders. The milling time was also increased to 2 hours and the 15 mm diam. balls were used. Originally dry milling was carried out which caused the powder to stick together along the walls of the vessel, which was very difficult to remove. Excessive mechanical force used to scratch the powder increased the fire risks, so wet milling was used by adding small amounts of cyclohexane to the mixture. This dramatically improved the quality of the resulting powder, which when pressed after drying in vacuum and addition of polymer as described in Example 1, produced remarkably good magnets as compared to the first attempt. The results obtained are shown in the Table 1 below.

In Examples 12 and 13, the as-cast ingots were homogenised for 10 hours at 1000° C. The improvement thereby achieved is apparent by comparison with Examples 7 and 8.

Deposition of metal by displacement from aqueous solutions has also been tried and the results are quite encouraging (see Example 6 in the Table 1 below).

TABLE 1

| Example | Material | Condition | Coating Material | % | Process | wt of Polymer | Remanence mT | Intrinsic Coercivity KA/m | Inductive Coercivity KA/m | BH Max KAT/m |
|---|---|---|---|---|---|---|---|---|---|---|
| Comparative | $Nd_2Fe_{14}B$ | NHD Powder | None | — | — | 10% | | NO COERCIVITY | | |
| 1 | $Nd_2Fe_{14}B$ | HD Powder | oxidised in air | | 2 hours at 100° C. | 10% | 595.48 | 101.72 | 90.27 | 11.95 |
| 2 | $Nd_2Fe_{14}B$ | NHD Powder | oxidised in air | | 1 hour at 100° C. | 10% | 562.76 | 170.12 | 153.12 | 18.22 |
| 3 | $Nd_2Fe_{14}B$ + 3 at .% Nb | NHD Powder | Sn | 10% | CM 4 hours | 10% | 551.36 | 250.40 | 180.77 | 20.74 |
| 4 | $Nd_2Fe_{14}B$ | HD | Zn | 10% | CM | 10% | | VERY WEAK | | |

TABLE 1-continued

| Example | Material | Condition | Coating Material | % | Process | wt of Polymer | Remanence mT | Intrinsic Coercivity KA/m | Inductive Coercivity KA/m | BH Max KAT/m |
|---|---|---|---|---|---|---|---|---|---|---|
| 5 | $Nd_2Fe_{14}B$ | Powder HD | Sn | 10% | ½ hour CM | 10% | | VERY WEAK | | |
| 6 | $Nd_2Fe_{14}B$ | Powder HD | Cu | 10% Aq sol | ½ hour Displacement | 10% | 347.2 | 253.2 | 167.9 | 11.4 |
| 7 | $Nd_2Fe_{14}B$ | Powder NON HD | Zn | 10% | CM 2 hours | 10% | 463.4 | 270.0 | 176.8 | 17.0 |
| 8 | $Nd_2Fe_{14}B$ | Powder NON HD | Sn | 10% | CM 2 hours | 10% | 378.6 | 226.6 | 151.5 | 12.9 |
| 9 | $Nd_2Fe_{14}B$ | Powder NON HD | Sn | 10% | CM 4 hours | 10% | 519.56 | 298.55 | 213.10 | 22.87 |
| 10 | $Nd_2Fe_{14}B$ | Powder NON HD | Zn | 10% | CM 4 hours | 10% | 530.398 | 171.026 | 152.20 | 14.817 |
| 11 | $Nd_2Fe_{14}B$ | Powder HD | Zn | 10% | CM 4 hours | | | VERY WEAK | | |
| 12 | $Nd_2Fe_{14}B$ Large Grain STARTING MATERIAL | Powder NHD | Zn | 10% | CM 2 hours | 10% | 538.87 | 429.543 | 251.361 | 28.325 |
| 13 | $Nd_2Fe_{14}B$ Large Grain STARTING MATERIAL | NHD | Sn | 10% | CM 2 hours | 10% | 482.115 | 154.248 | 127.39 | 13.13 |
| 14 | $Nd_2Fe_{14}B$ | HD Powder | Zn | 10% | CM 4 hours | | | VERY WEAK | | |

NHD = Non-hydrogenated
HD = Hydrogenated.
CM = Co-Milled.
D = Displacement from Solution.

EXAMPLES 15 to 47

As cast, 214 ingot ($Nd_2Fe_{14}B$, 95% pure Nd) is homogenized at 1100° C. for a time as set forth in Table 2 below. In the Examples marked "(DY") in the first column, the alloy used is a stoichiometric alloy based on $Nd_2Fe_{14}B$, but containing 1.5 wt % of Dy as replacement for part of the Nd. Following this, the homogenized material is crushed manually under a power press and screened to approx 1 mm particles. Then, these particles are milled using a slow roller mill and/or a high energy planetary ball mill in cyclohexane so as to exclude air for a period of time as set forth in Table 2 below. In some of the Examples, such milling is effected with coating material and in other Examples, milling of the alloy particles above is effected with subsequent oxidation using dry air or pure oxygen ($O_2$) to produce an oxide coating thereon. The conditions are set forth in Table 2 below. Following milling and coating, the coated particles are formed into a coherent body by (a) GC—alignment in a magnetic field followed by isostatic pressing to form a green compact having a density of about 60% of the theoretical density, (b) CC—cold compacting with alignment in a magnetic field, or (c) PB—mixing with 10% polymer binder and cold pressing with alignment in a magnetic field. The conditions and results achieved are set forth in Table 2 below. In these Examples, cold compacting is effected using a rotary forging machine available from Penny & Giles Blackwood Ltd to obtain a body having a density of about 80% of the theoretical density.

TABLE 2

| Example No. | Homog Time (hrs) | Milling Time (hrs) | Coating % by wt. | Oxid. Temp °C. | Oxid. Time (mins) | Body Type | Applied Field | Intrin Coerc kA/m | Induct Coerc kA/m | Br mT | BHmax kAT/m |
|---|---|---|---|---|---|---|---|---|---|---|---|
| 15 (DY) | 50 | 48 (roller) 1 (ball) | 15% Zn | — | — | CC | 100A (1.2 T) | 195 | — | 544 | 20 |
| 16 (DY) | 90 | 48 (roller) 1 (ball) | " | — | — | CC | " | 265 | — | 704 | 42 |
| 17 (DY) | 130 | 48 (roller) 1 (ball) | " | — | — | CC | " | 245 | 219 | 796 | 56 |
| 18 | 72 | 4 (ball) | 5% Cu | — | — | PB | aligned in approx. 1 T | 230 | — | 250 | 10.3 |
| 19 | 72 | 4 (ball) | 10% Cu | — | — | PB | aligned in approx. 1 T | 205 | — | 310 | 19.5 |
| 20 | 72 | 4 (ball) | 15% Cu | — | — | PB | aligned in approx. 1 T | 190 | — | 375 | 25.5 |
| 21 | 72 | 4 (ball) | 20% Cu | — | — | PB | aligned in approx. 1 T | 195 | — | 520 | 27.8 |
| 22 | 72 | 1.5 (ball) | 10% Cu | — | — | PB | aligned in approx. 1 T | 326 | 215 | 437 | 19 |
| 23 | 72 | 3 (ball) | 10% Cu | — | — | PB | aligned in approx. 1 T | 345 | 235 | 530 | 30 |
| 24 | 72 | 4 (ball) | 10% Cu | — | — | PB | aligned in approx. 1 T | 442 | 283 | 580 | 39 |
| 25 | 72 | 10 (ball) | 10% Cu | — | — | PB | aligned in approx. 1 T | 942 | 393 | 600 | 43 |
| 26 (DY) | 130 | 48 roller | 15% Zn | — | — | CC | 30A (0.6 T) | 258 | 183 | 360 | 15.6 |

TABLE 2-continued

| Example No. | Homog Time (hrs) | Milling Time (hrs) | Coating % by wt. | Oxid. Temp °C. | Oxid. Time (mins) | Body Type | Applied Field | Intrin Coerc kA/m | Induct Coerc kA/m | Br mT | BHmax kAT/m |
|---|---|---|---|---|---|---|---|---|---|---|---|
| 27 (DY) | 130 | 1 (ball) 48 (roller) | 15% Zn | — | — | CC | 45A (0.8 T) | 183 | 158 | 526 | 29.2 |
| 28 (DY) | 130 | 1 (ball) 48 (roller) | 15% Zn | — | — | CC | 100A (1.2 T) | 245 | 219 | 796 | 56 |
| 29 (DY) | 120 | 1 (ball) 12 (ball) | oxide (dry air) | 40 | 20 | GC | pulsed 6 T | 193 | 136 | 419 | 18.6 |
| 30 (DY) | 120 | " | oxide (dry air) | 60 | 20 | GC | pulsed 6 T | 178 | 130 | 395 | 15.3 |
| 31 (DY) | 120 | 12 (ball) | oxide (dry air) | 80 | 20 | GC | pulsed 6 T | 158 | 120 | 376 | 13.9 |
| 32 (DY) | 120 | " | oxide (dry air) | 100 | 20 | GC | pulsed 6 T | 126 | 98 | 288 | 8 |
| 33 (DY) | 120 | " | oxide (dry air) | 60 | 5 | GC | pulsed 6 T | 155 | 126 | 414 | 17.9 |
| 34 (DY) | 120 | " | oxide (dry air) | 60 | 10 | GC | pulsed 6 T | 163 | 125 | 426 | 18.3 |
| 35 (DY) | 120 | " | oxide (dry air) | 60 | 15 | GC | pulsed 6 T | 158 | 119 | 417 | 16.8 |
| 36 (DY) | 120 | " | oxide (dry air) | 60 | 20 | GC | pulsed 6 T | 147 | 118 | 413 | 16.6 |
| 37 (DY) | 120 | " | oxide (dry air) | 60 | 40 | GC | pulsed 6 T | 145 | 116 | 410 | 15.8 |
| 38 (DY) | 120 | " | oxide (dry air) | 60 | 60 | GC | pulsed 6 T | 153 | 114 | 404 | 16.7 |
| 39 (DY) | 120 | " | oxide ($O_2$) | 55 | 5 | GC | pulsed 6 T | 117 | 98 | 459 | 15.5 |
| 40 (DY) | 120 | " | " | 40 | 5 | GC | pulsed 6 T | 125 | 105 | 508 | 18.5 |
| 41 (DY) | 120 | " | " | 70 | 5 | GC | pulsed 6 T | 116 | 106 | 495 | 17.1 |
| 42 (DY) | 120 | " | " | 55 | 15 | GC | pulsed 6 T | 117 | 99 | 414 | 13.2 |
| 43 (DY) | 120 | " | " | 40 | 15 | GC | pulsed 6 T | 118 | 109 | 566 | 20.5 |
| 44 (DY) | 120 | " | " | 70 | 15 | GC | pulsed 6 T | 115 | 107 | 512 | 18. |
| 45 (DY) | 120 | " | " | 55 | 25 | GC | pulsed 6 T | 119 | 109 | 457 | 16 |
| 46 (DY) | 120 | " | " | 40 | 25 | GC | pulsed 6 T | 121 | 102 | 496 | 18 |
| 47 (DY) | 120 | " | " | 70 | 25 | GC | pulsed 6 T | 120 | 101 | 527 | 18.4 |

In connection with Examples 15, 16, 17, 26, 27 and 28, the applied field is measured in terms of the current passing through the coil. The figures given in brackets are estimations of the applied field at the sample.

If, during homogenization of the particular alloy concerned, there is a slight loss of one of some of the components of the alloy through volatilization, then it is within the scope of the invention to start with an alloy which is slightly rich in respect of said component(s) so that, after homogenization, a substantially stoichiometric alloy composition results.

We claim:

1. A permanent magnet, comprising a coherent non-sintered body comprised of a particulate, stoichiometric alloy, wherein said alloy had uniaxial magnetocrystalline anisotropy and the surfaces of the particles have a continuous coating thereon of a material selected from the group consisting of a reaction product of the alloy and a non-magnetic metal, wherein said reaction product is selected from the group consisting of oxides, chlorides, nitrides, carbides, borides, silicides, fluorides, phosphides and sulphides of the alloy, and said non-magnetic metal is selected from the group consisting of tin, gallium, zinc, aluminum and copper.

2. The permanent magnet of claim 1, wherein the alloy is selected from the group consisting of stoichiometric $R_2Fe_{14}B$ and $R_2Fe_{14-x}Co_xB$, wherein R is at least one element selected from the group consisting of rare earth metals, heavy rare earth metals and yttrium, and x is less than 14.

3. A method of producing a permanent magnet, comprising:

(a) forming particles from a stoichiometric alloy, which has uniaxial magnetocrystalline anisotropy;

(b) producing a continuous coating on said particles of a material selected from the group consisting of a reaction product of the alloy and a non-magnetic metal, wherein said reaction product is selected from the group consisting of oxides, chlorides, nitrides, carbides, borides, silicides, fluorides, phosphides and sulphides of the alloy, and said non-magnetic metal is selected from the group consisting of tin, gallium, zinc, aluminum and copper; and (c) forming a coherent non-sintered body comprising the coated alloy particles.

4. The method of claim 3, wherein the alloy is selected from the group consisting of stoichiometric $R_2Fe_{14}B$ and $R_2Fe_{14-x}Co_xB$, wherein R is at least one element selected from the group consisting of rare earth metals, heavy rare earth metals and yttrium, and x is less than 14.

5. The method of claim 3, further comprising homogenizing said alloy between steps (a) and (b), whereby the amount of free iron in said alloy is eliminated or at least substantially reduced.

6. The method of claim 3, wherein said coating is produced by milling the alloy with said non-magnetic metal.

7. The method of claim 3, wherein the coherent non-sintered body is formed by cold compacting the coated particles.

8. The method of claim 3, wherein the coherent non-sintered body is formed by mixing the coated particles with a binder and pressing said mixture.

9. The permanent magnet of claim 2, further comprising at least one additional element selected from the group consisting of Ti, Ni, Bi, V, Nb, Cu, Ta, Cr, Mo, W, Mn, Al, Sb, Ge, Sn, Zr, Ga, Si, and Hf.

10. The method of claim 4, wherein said alloy also includes at least one additional element selected from the group consisting of Ti, Ni, Bi, V, Nb, Cu, Ta, Cr, Mo, W, Mn, Al, Sb, Ge, Sn, Zr, Ga, Si, and Hf.

11. A method of producing a permanent magnet, comprising:

(a) forming particles from a substantially stoichiometric alloy, which has uniaxial magnetocrystalline anisotropy;

(b) producing a continuous coating on said particles consisting of a reaction product of the alloy formed by controlled oxidation of said alloy particles to provide a continuous oxide coating thereon, said reaction product being selected from the group consisting of oxides, chlorides, nitrides, carbides, borides, silicides, fluorides, phosphides and sulphides of the alloy; and (c) forming a coherent non-sintered body comprising said coated alloy particles.

* * * * *